US005760671A

United States Patent [19]

Lahr et al.

[11] Patent Number: 5,760,671

[45] Date of Patent: Jun. 2, 1998

[54] TRANSFORMER WITH DUAL FLUX PATH

[75] Inventors: Terry Chester Lahr, Friendsville, Pa.; Garey George Roden, Apalachin, N.Y.

[73] Assignee: Celestica Inc., Toronto, Canada

[21] Appl. No.: 529,112

[22] Filed: Sep. 15, 1995

[51] Int. Cl.[6] ..... H01F 5/00

[52] U.S. Cl. ..... 336/200

[58] Field of Search ..... 336/200, 184

[56] References Cited

U.S. PATENT DOCUMENTS

| | | | |
|---|---|---|---|
| 5,463,365 | 10/1995 | Iwatani et al. | 336/200 |
| 5,600,293 | 2/1997 | Hunter | 336/182 |
| 5,606,488 | 2/1997 | Gustafson | 361/782 |

FOREIGN PATENT DOCUMENTS

| | | |
|---|---|---|
| 485909 | 3/1992 | Japan . |
| 485910 | 3/1992 | Japan . |
| 488609 | 5/1992 | Japan . |
| 488612 | 5/1992 | Japan . |
| 4134810 | 5/1992 | Japan . |
| 5258958 | 10/1993 | Japan . |

*Primary Examiner*—Michael L. Gellner
*Assistant Examiner*—Daniel Chapik
*Attorney, Agent, or Firm*—Blake, Cassels & Graydon

[57] ABSTRACT

A transformer comprises a ferrite core and a printed circuit board for primary and/or secondary windings. The ferrite core comprises first and second trunk portions parallel with each other and first and second leg portions parallel with each other. The trunks and first and second leg portions are positioned into a rectangular configuration. The core also comprises a third leg portion parallel to the first and second leg portions and interposed midway between the trunk portions. A cross-sectional area of the first and second leg portions is approximately the same as each other, approximately one half the cross-sectional area of the third leg portion, less than the cross-sectional area of the first trunk portion and less than the cross-sectional area of the second trunk portion. The core is mounted to the printed circuit board such that the first, second and third legs extend through openings in the printed circuit board and the windings surround the third leg portion inside of the first and second leg portions. The core further comprises first and second step portions extending from the first and second trunk portions adjacent and interior to the first and second leg portions, respectively. The first and second step portions have a shorter length than the first and second leg portions and abut against one surface of the printed circuit board, whereby the first trunk portion is offset from one surface of the printed circuit board.

12 Claims, 11 Drawing Sheets

TRANSFORMER WITH DUAL FLUX PATH

BACKGROUND OF THE INVENTION

The present invention relates generally to transformers, and deals more particularly with an improved transformer core design which accepts a large number of associated windings which may be fabricated on a printed circuit board.

Transformers are useful in power supplies and many other products. A typical transformer comprises a ferrite core to contain a magnetic field, primary windings formed around the core and excited with an alternating current to generate the magnetic field and secondary windings formed around the core to yield a voltage and current in response to the magnetic field. There are many known shapes for the core. One shape is torroidal with the primary and secondary windings either interlaced with each other or spaced from each other. The windings may be wrapped entirely around the core or wrapped on three sides and provided by conductors of a printed circuit board on the fourth side. Such a configuration generates a single magnetic flux path—around the core.

Another prior art core 9 is shaped as a "squared-off" number "8" (i.e. a rectangle with an additional middle leg) with three "legs" and two "trunks" as illustrated in FIGS. 1(*a,b*) and 2(*a,b*). The core 9 of FIG. 1 has two "wells" 10*a,b* to receive two strip-shaped portions 13*a,b* of a multi-layered printed circuit board 11 containing primary windings 12 and secondary windings 14. The primary windings 12 are printed on respective layers of the printed circuit board 11 in a spiral configuration surrounding the middle leg, and the secondary windings 14 are printed on other respective layers of the printed circuit board 11 also in a spiral configuration surrounding the middle leg. To facilitate fabrication, the core is formed from an "E-shaped" section 15 and a separate bar shaped section 17 which are later glued, clipped or taped together or fastened by alternate mechanical means, to encompass the strip-shaped portions 13*a,b* of the printed circuit board. This configuration provides two flux paths 20*a,b* as illustrated in FIG. 1(*a*). Each of the flux paths comprises magnetic core material of constant cross-section. This is because the cross-section A—A of each outer leg is the same as the cross-section B—B of each trunk and half the cross-section C—C of the middle leg. The middle leg provides the core material for both flux paths 20*a,b* and shared for each flux path, resulting in flux paths 20*a,b* with essentially constant cross-section.

Because of current carrying requirements, each printed winding must have a minimum width. The wells 10,*b* of the foregoing core design are limited in size and this limits the number of windings that can be used. Also, to prevent "creapage" from the core material through the insulating material of the printed circuit board to the windings, there must be a minimum distance between the core material and the innermost winding. This distance sacrifices valuable area on the printed circuit board that could otherwise be used for additional windings.

Accordingly, a general object of the present invention is to provide an improved transformer of the foregoing type with either a greater number of windings or windings of higher cross-sectional area to carry higher current.

SUMMARY OF THE INVENTION

The invention resides in a transformer comprising a ferrite core and a printed circuit board for primary windings and/or secondary windings. The ferrite core comprises first and second trunk portions parallel with each other and first and second leg portions parallel with each other. The trunks and first and second leg portions are positioned into a rectangular configuration. The core also comprises a third leg portion parallel to the first and second leg portions and interposed midway between the trunk portions. A cross-sectional area of the first and second leg portions is approximately the same as each other, approximately one half the cross-sectional area of the third leg portion, less than the cross-sectional area of the first trunk portion and less than the cross-sectional area of the second trunk portion. The core is mounted to the printed circuit board such that the first, second and third legs extend through openings in the printed circuit board and the windings surround the third leg portion inside of the first and second leg portions. This configuration permits more or wider windings (for a given flux density) than if the cross-sectional area of the first and second legs was the same as the cross-sectional are of the first and second trunk portions.

According to another feature of the present invention, the core further comprises first and second step portions extending from the first and second trunk portions adjacent and interior to the first and second leg portions, respectively. The first and second step portions have a shorter length than the first and second leg portions. The first and second steps abut against one surface of the printed circuit board, whereby the first trunk portion is offset from one surface of the printed circuit board. This prevents creepage from the core material to the printed windings and is more effective than the dielectric material of the printed circuit board.

According to still another feature of the present invention, a middle one of the openings of the printed circuit board is shaped and positioned to leave air gaps between four surfaces of the middle leg and adjacent edges of the printed circuit board. This also prevents creepage from the core material to the printed windings and is more effective than the dielectric material of the printed circuit board.

DETAILED DESCRIPTION OF THE PREFERRED EMBODIMENTS

Figure 1:
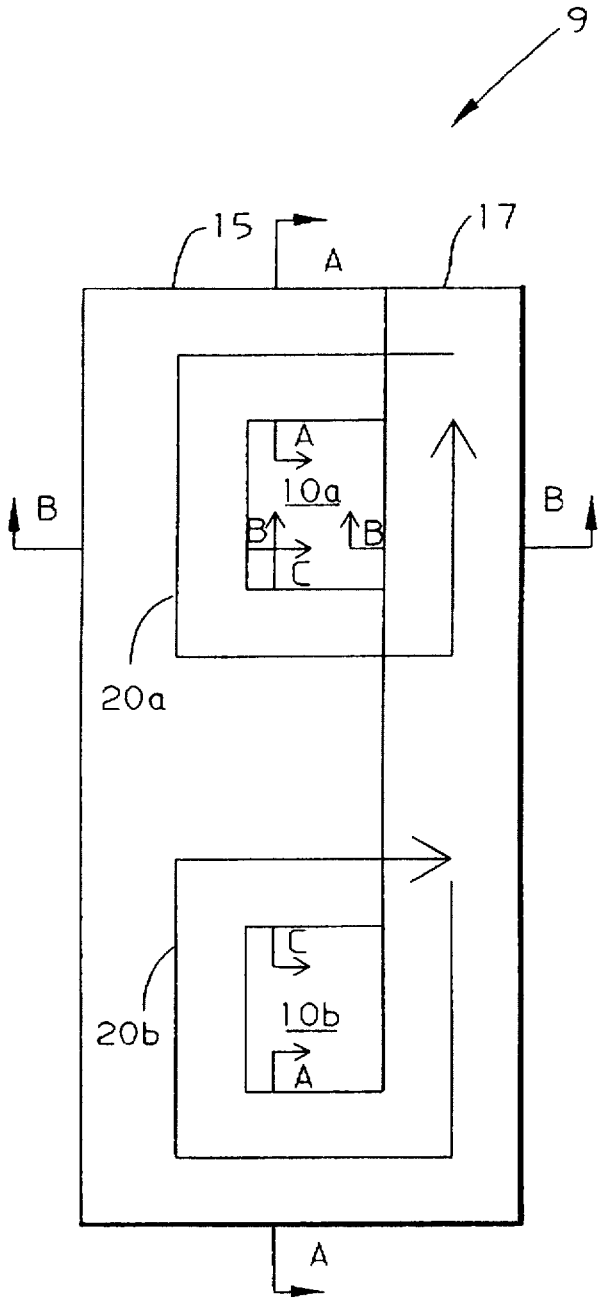
FIG. 1 (a) (PRIOR ART)
FIGS. 1(*a,b*) illustrate a transformer core according to the prior art.
Figure 1:
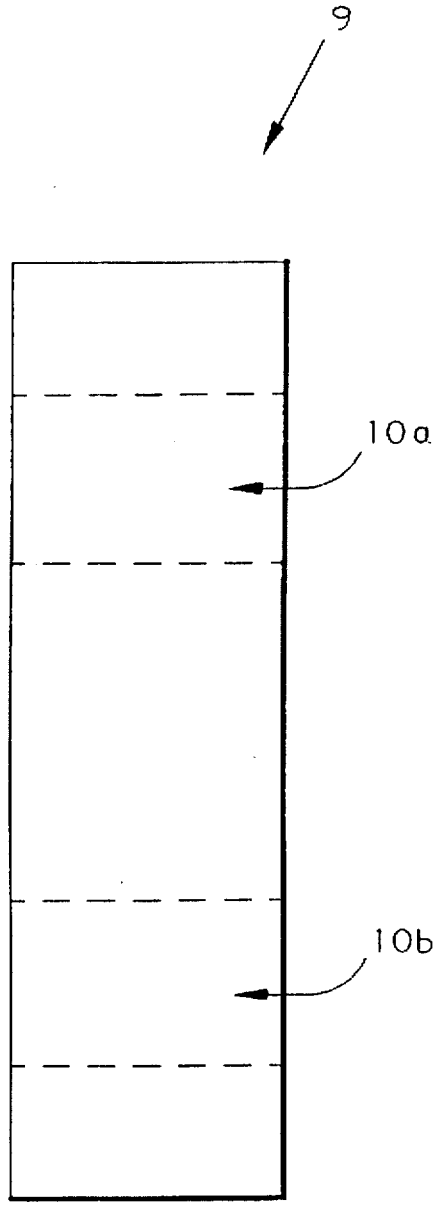
FIG. 1 (b) (PRIOR ART)
Figure 2:
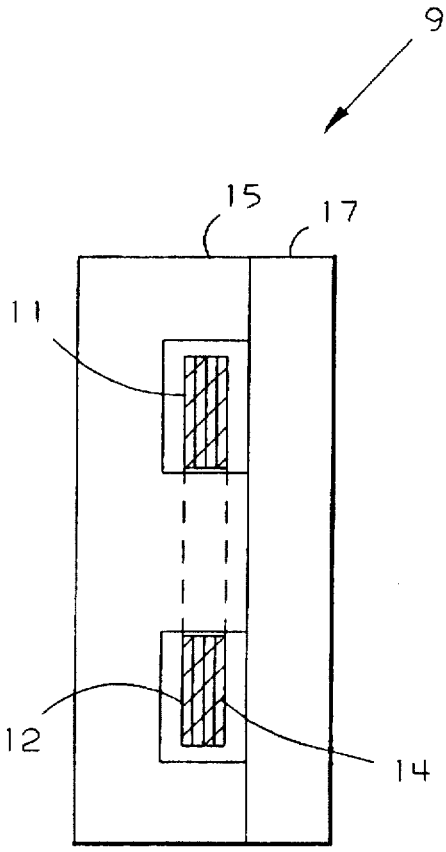
FIG. 2 (a) (PRIOR ART)
FIGS. 2(*a,b*) illustrate a transformer according to the prior art including the transformer core of FIGS. 1(*a,b*).
Figure 2:
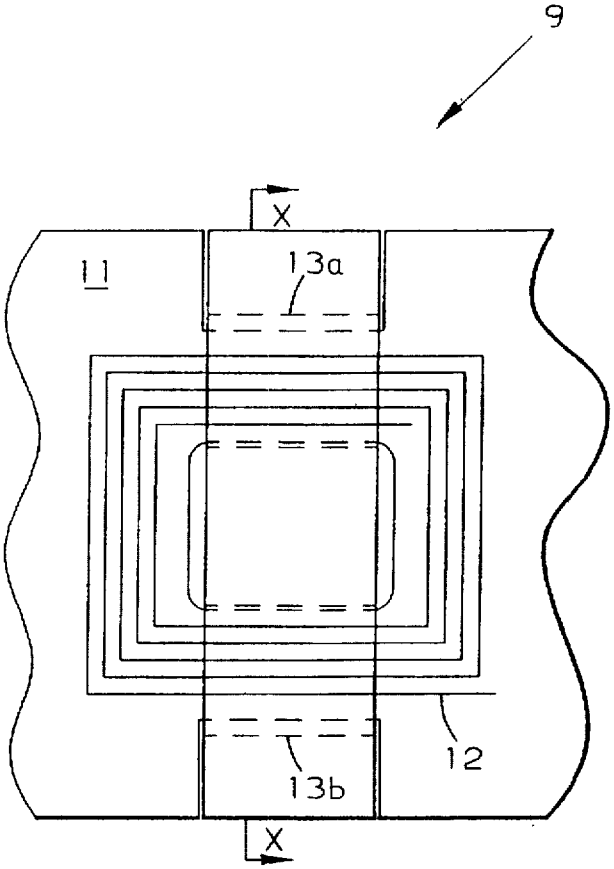
FIG. 2 (b) (PRIOR ART)
Figure 3A:
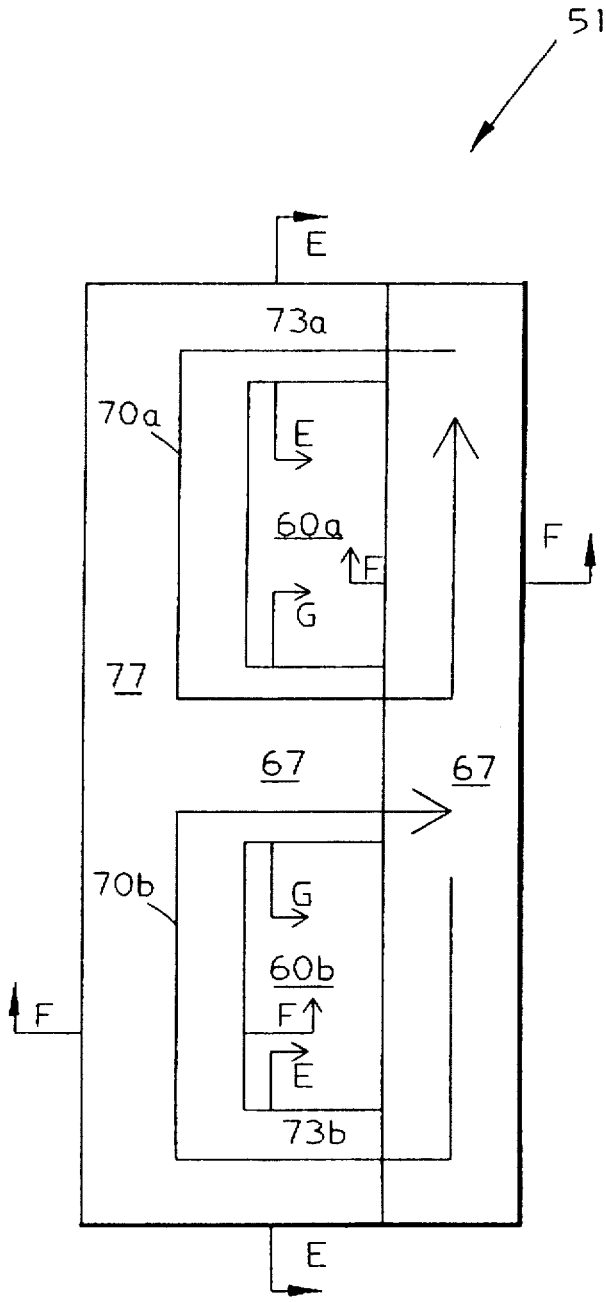
FIGS. 3(*a,b*) illustrate a transformer core according to the present invention.
Figure 3B:
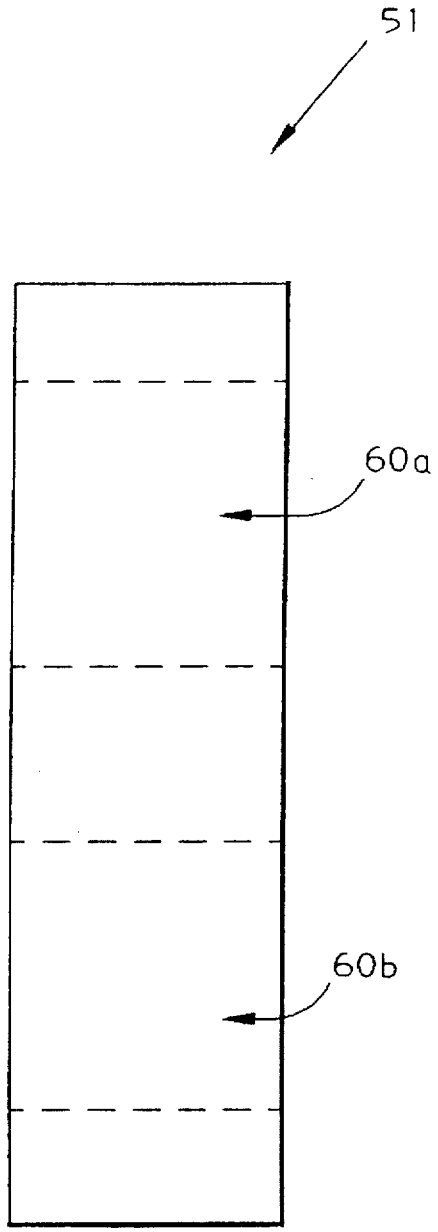
Figure 4:
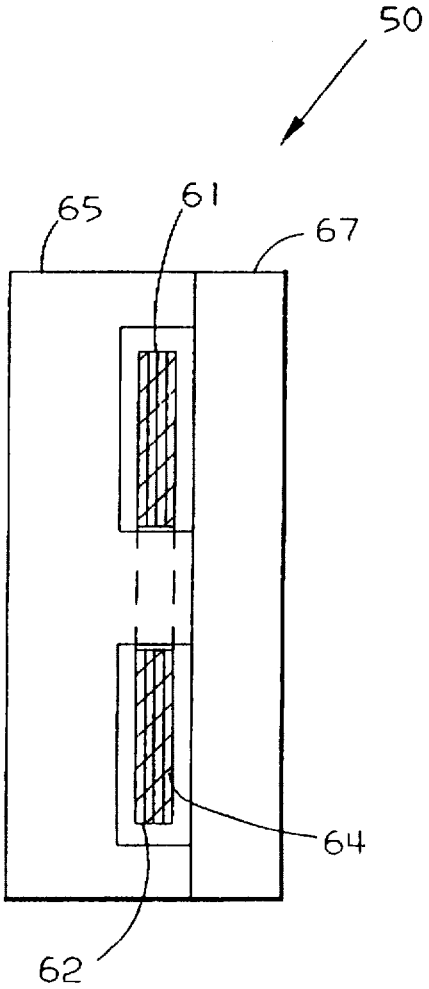
FIGS. 4(*a,b*) illustrate a transformer according to the present invention including the transformer core of FIGS. 3(*a,b*).
Figure 4:
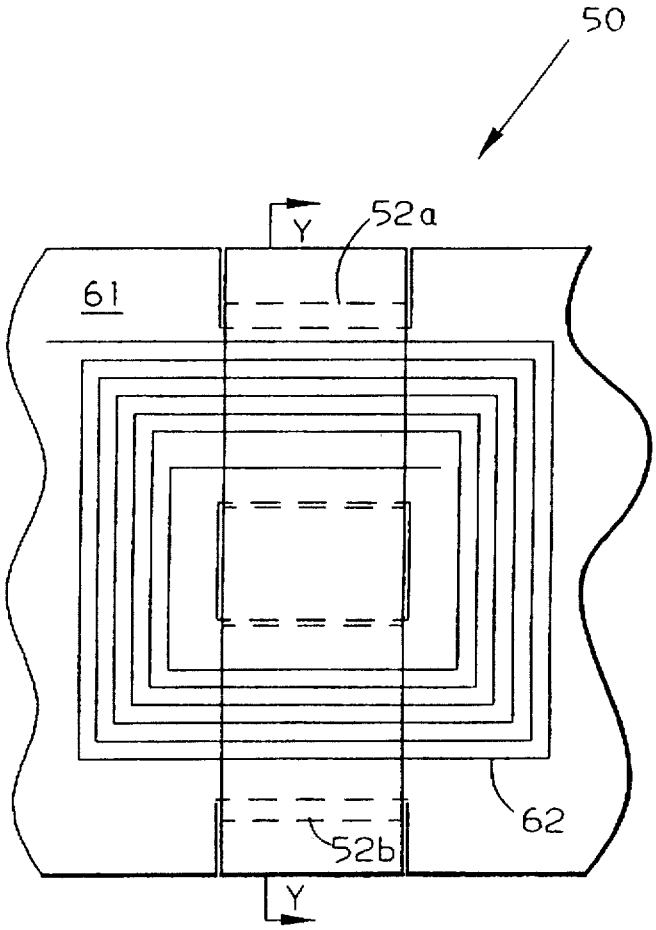
Figure 5A:
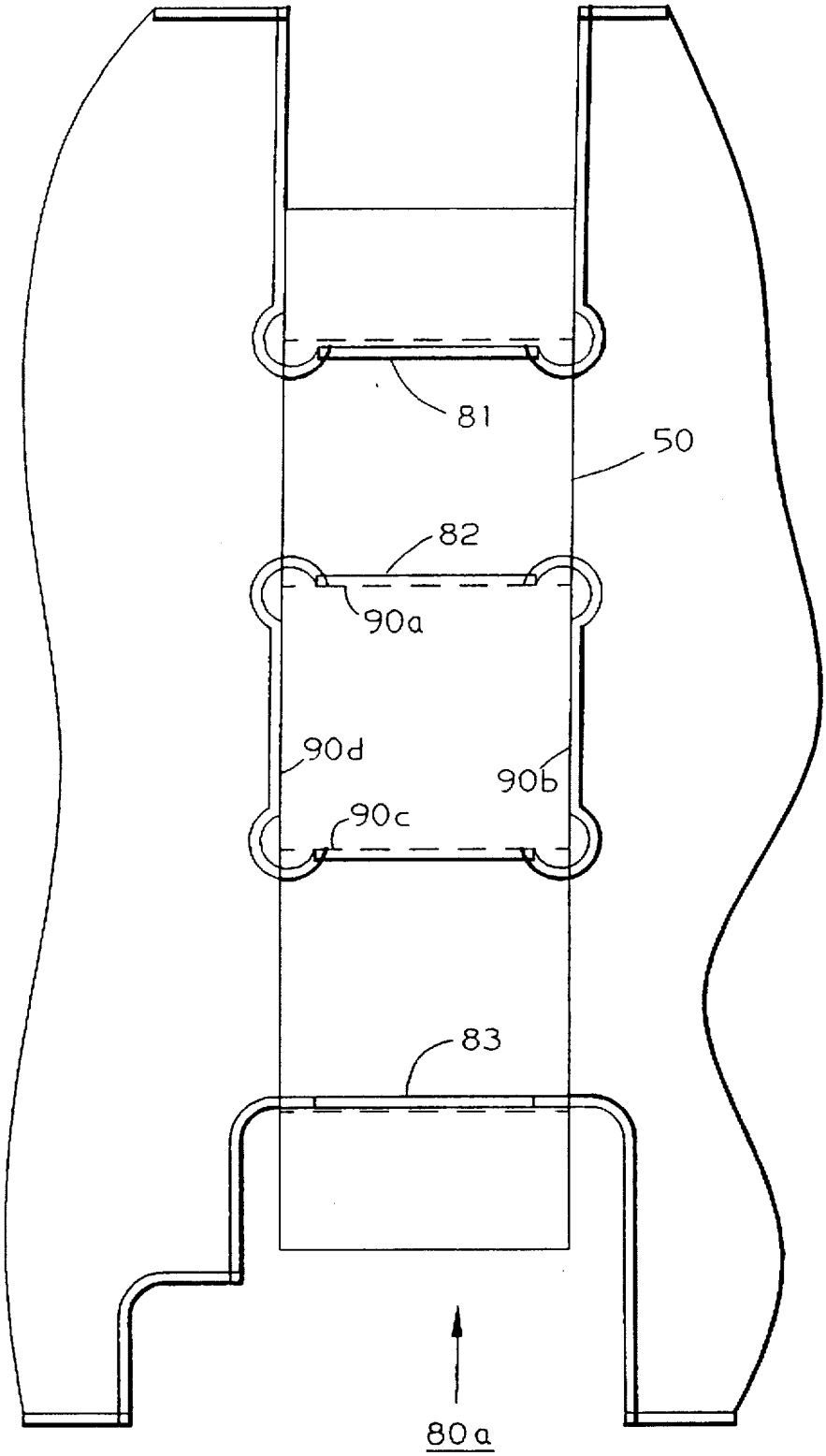
FIGS. 5(*a–f*) illustrate the transformer of FIGS. 4(*a,b*) including each layer of a printed circuit board that forms the windings within the transformer.
Figure 5B:
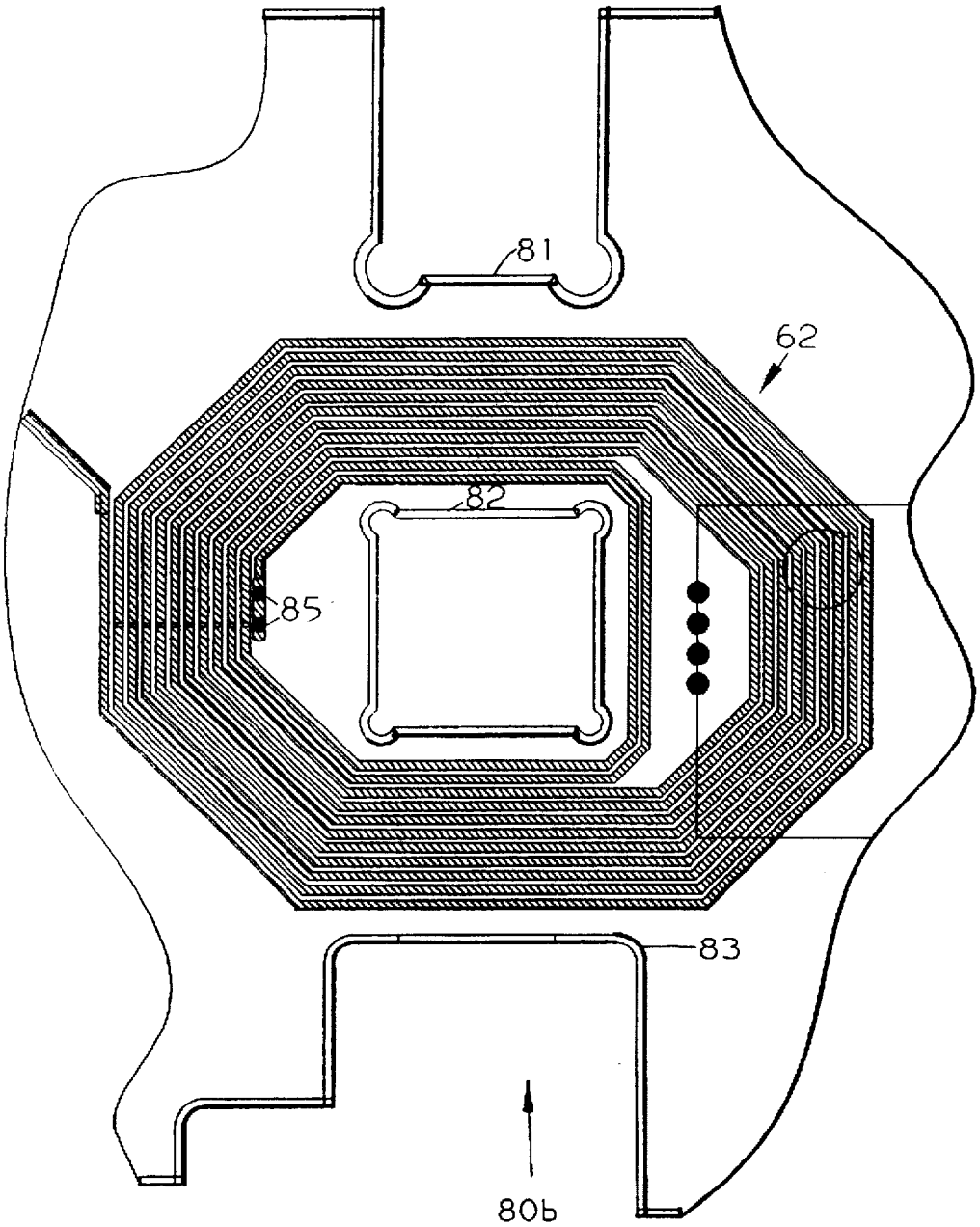
Figure 5C:
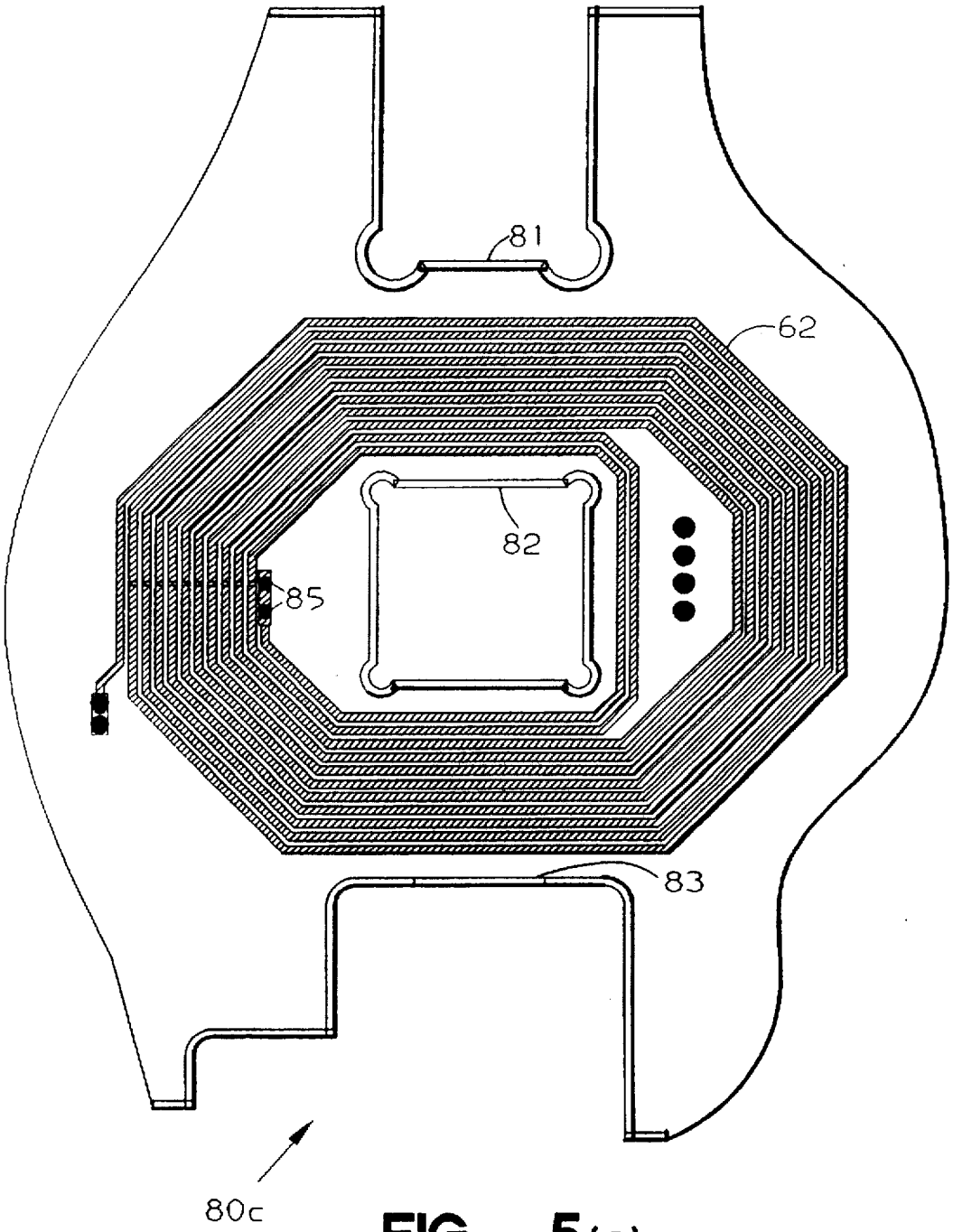
Figure 5D:
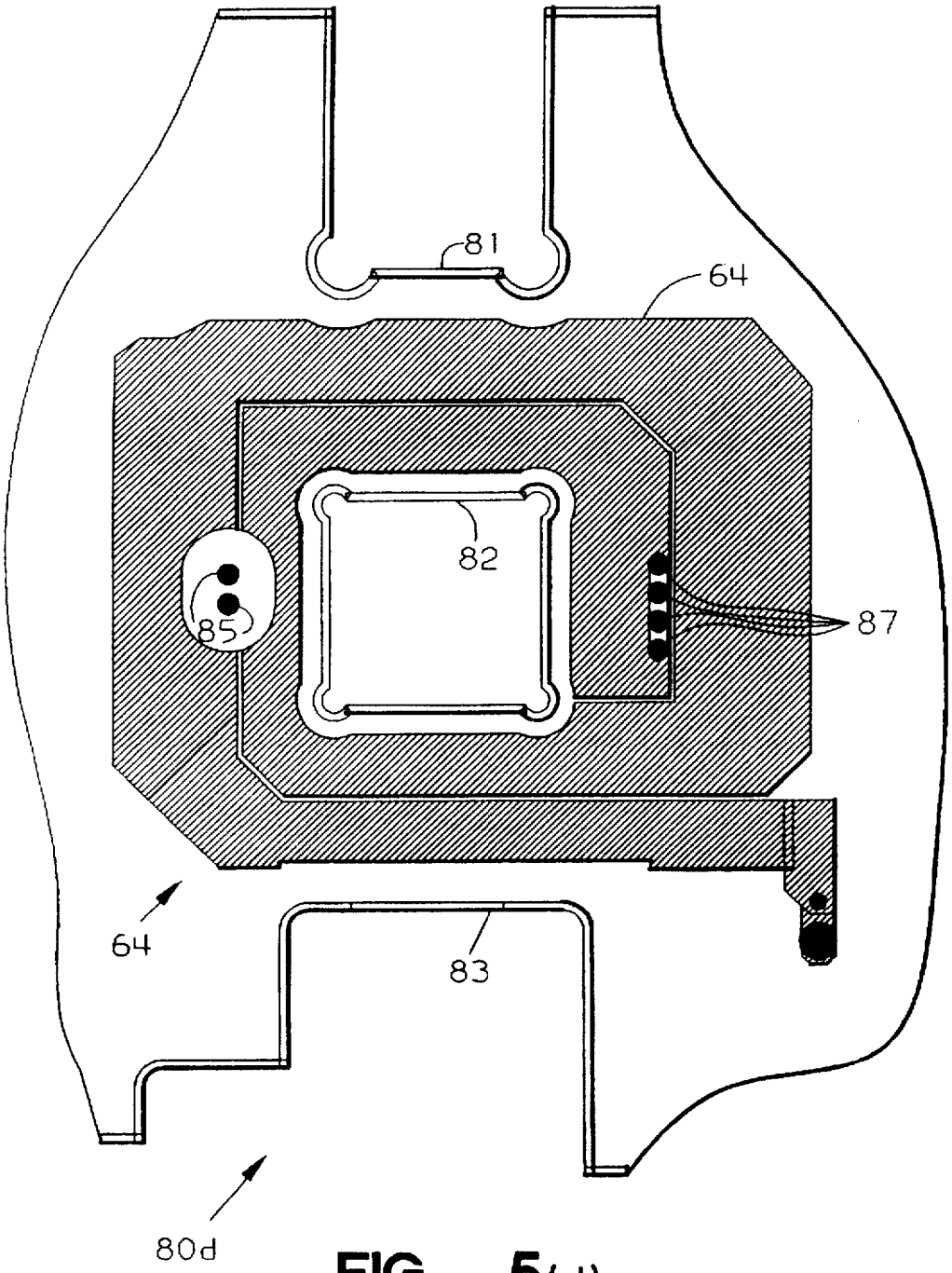
Figure 5E:
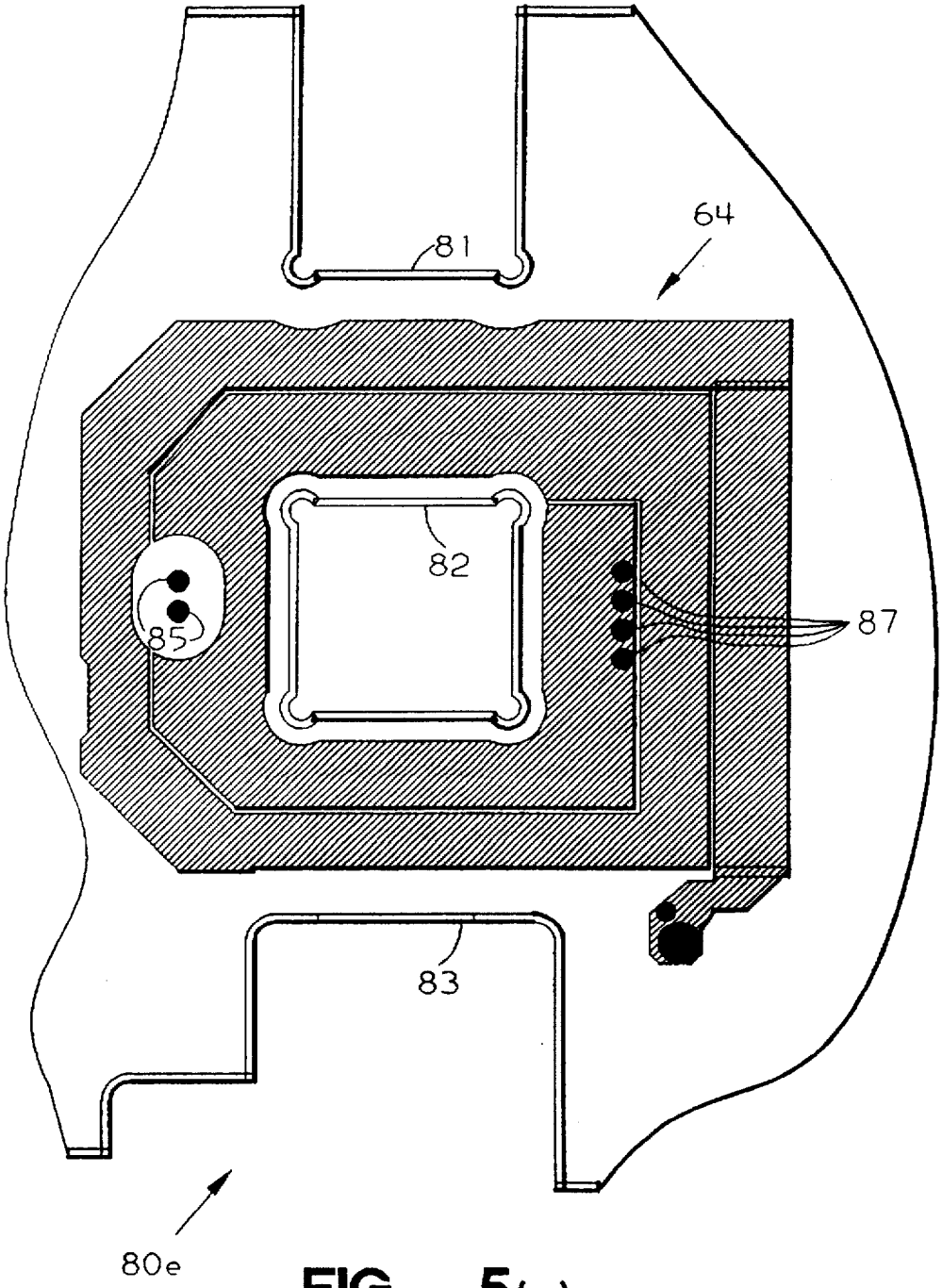
Figure 5F:
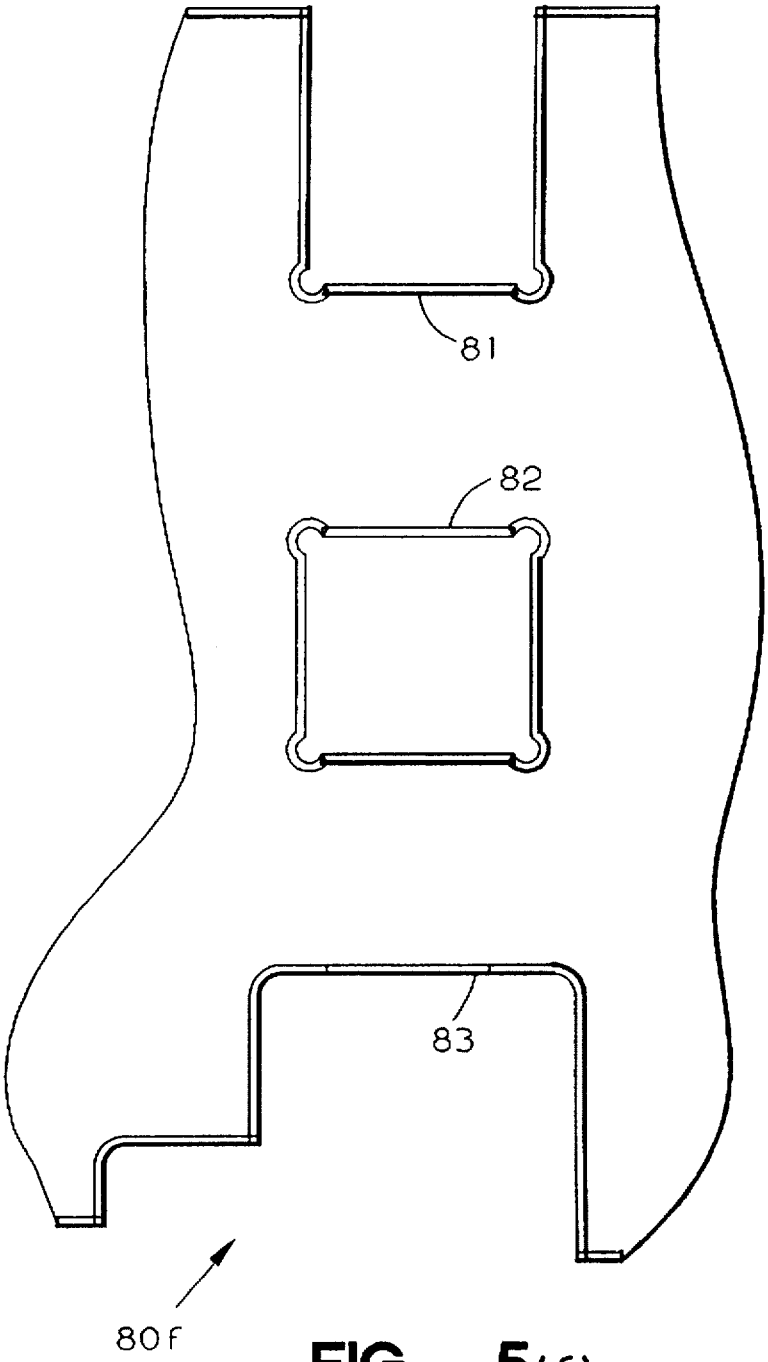

Referring now to FIGS. 3–6 in detail, wherein like reference numbers indicate like elements throughout, FIG. 3(*a,b*) and 4(*a,b*) illustrate a transformer generally designated 50 according to the present invention. Transformer 50 comprises a ferrite core 51 having a "squared off" number "8" shape (i.e. rectangular with an additional middle leg). Core 51 has two "wells" 60*a,b* to receive two strip-shaped portions 52*a,b* of a multi-layered printed circuit board 61 containing primary windings 62 and secondary windings 64. The primary windings 62 are printed on respective layers of the printed circuit board 61 in a spiral configuration which surrounds the middle leg, and the secondary windings 64 are printed on other respective layers of the printed circuit board 61 also in a spiral or single turn configuration which surrounds middle leg 67. To facilitate fabrication, the core is formed from an "E-shaped" section 65 and a separate bar shaped section 67 which are later glued, clipped or taped together or attached by alternate mechanical means, to encompass the strip-shaped portions 52*a,b* of the printed circuit board 61. This configuration provides two flux paths 70*a,b* as illustrated in FIG. 3(*a*). The cross-section E—E of each outer leg 73*a,b* is the same as each other and half the cross-section G—G of the middle leg 67. The middle leg provides the core material for both flux paths and is shared for each flux path. Nevertheless, each of the flux paths comprises ferrite core material of non-uniform cross-section because the cross-section F—F of each trunk 67,77 is larger, for example 1.5 times larger than the cross-section E—E of each outer leg. The foregoing configuration results in larger wells 60*a,b* for the primary and secondary windings as compared to the wells 10*a,b* of the prior art configuration illustrated in FIG. 1(*a,b*). This permits a larger number of primary and secondary windings than would fit in the wells 10*a,b* of the configuration of FIG. 1(*a,b*). While the reduced cross-section of the legs 73*a,b* and 67 (compared to the prior art) increases the flux density and may increase heat dissipation, one of the trunks is preferably attached to a heat sink (as in the prior art). By way of example, the following are dimensions for the core 51 of one embodiment of the present invention.

E—E cross-section—0.130"×0.600"
F—F cross-section—0.300"×0.600"
G—G cross-section—0.270"×0.600"
(F—F is 1.5 times ½ G—G and greater than 1.0)
overall length of core—1.85"
overall width of core—0.600"
length of well—0.660"
width of well—0.600"

FIGS. 5*a–f* illustrate in detail, respective layers 80*a–f* of the multilayer printed circuit board 61 in relation to the core 51. Layer 80*a* is a first, outer layer which does not contain any windings but instead is included for insulation purposes. Layer 80*b* is a next, second layer which contains multiple primary windings 62 in a spiral configuration. Layer 80*c* is a next, third layer which contains multiple primary windings 62 in a spiral configuration. The primary windings of layer 80*c* are series connected, using metallic vias 85, to the primary windings of layer 80*b*. In the illustrated embodiment, layer 80*b* contains eleven primary windings and layer 80*c* contains eleven primary windings resulting in a total of twenty two primary windings. "Vias" are well known in printed circuit board manufacturing and are formed by drilling a hole through two or more layers and then plating the hole with a metallic material such as Cu. Layer 80*d* is a next, fourth layer and contains a plurality of secondary windings 64 in a spiral configuration. Layer 80*e* is a next, fifth layer and contains a plurality of secondary windings 64 in a spiral configuration. In the illustrated example, layer 80*d* contains two secondary windings and layer 80*e* contains two secondary windings, and they are series connected using metallic vias 87. Vias 87 also provide a center tap. Layer 80*f* is a next, sixth layer which does not contain any windings but instead is included for insulation purposes. Each of the layers includes three cut-outs 81–83 to receive the three legs 67, 73*a,b* of the core.

Figure 6:
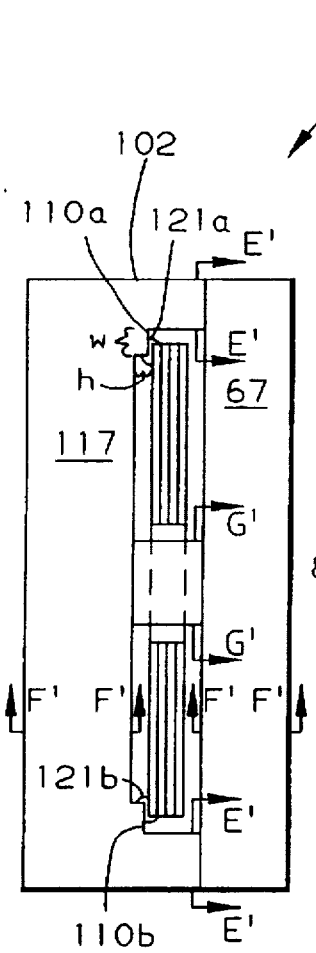
FIGS. 6(*a,b*) illustrate another transformer according to another embodiment of the present invention.
Figure 6:
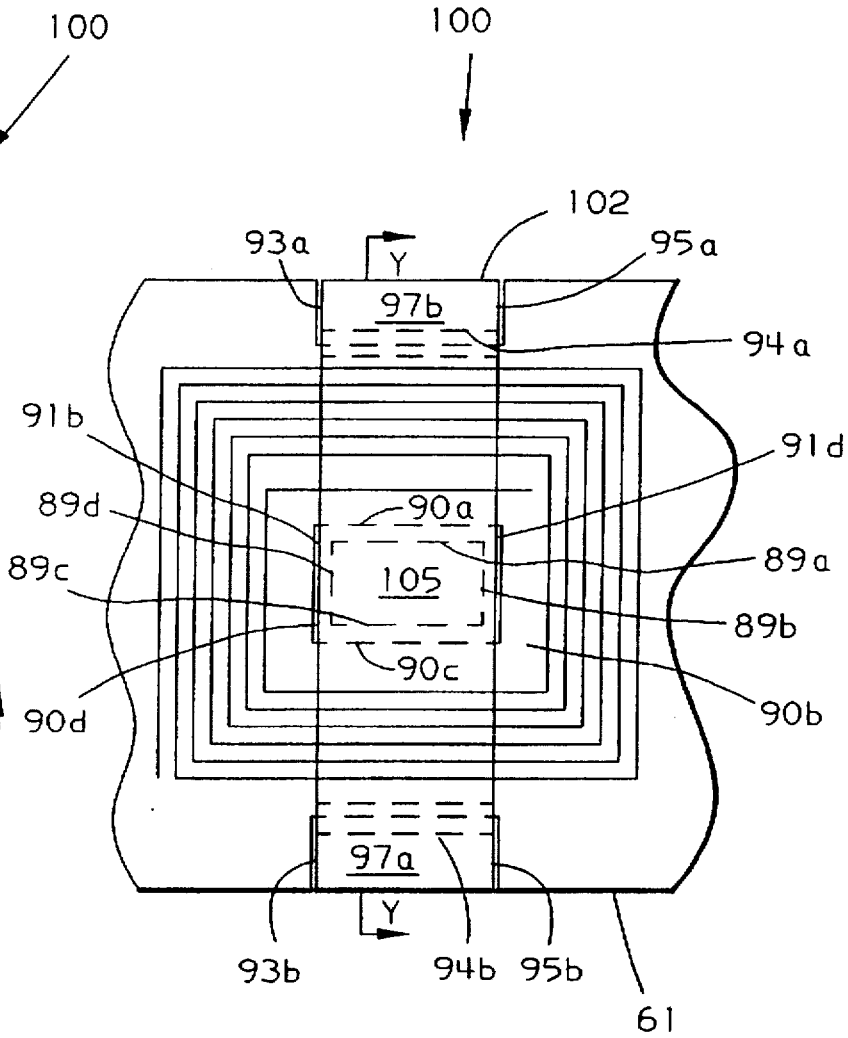

FIGS. 6(*a,b*) illustrate another transformer generally designated 100 according to another embodiment of the present invention. Transformer 100 comprises a ferrite core 102 which has the same dimensions as core 51 except for the presence in core 102 of steps 110*a,b*. Steps 110*a,b* abut one face/outer layer 80*f* of printed circuit board 61 to space trunk 117 away from the printed circuit board 61. This ensures lack of electrical "creepage" between the trunk 117 and the windings in the printed circuit board 61, and is helpful allowing a wider trunk section of the E shaped core while maintaining proper creepage distance on the row card. By way of example, a height "h" of each step 110*a,b* is greater than one millimeter, for example, 1.2 millimeter. A width "w" of each step 110*a,b* is the minimum required to guarantee contact with the printed circuit board 61 in view of dimensional tolerances of the printed circuit board 61 and cut-outs 81–83. By way of example, width "w" is 1.5 millimeters. To ensure spacing from the other face/outer layer 80*a* of the printed circuit board 61 and the bar shaped core section 67, the printed circuit board 61 is glued (by epoxy 121*a,b*) (or alternately clipped, taped or mechanically attached by other means or held against the steps by means of a compressible washer, thermal pad, etc.) to the steps 110*a,b*. Also, outer legs 121*a,b* project beyond the printed circuit board 61 to space the bar shaped core section 67 from the printed circuit board 61. By way of example, outer legs 121*a,b* project at greater than 1.0 millimeters plus the thickness of the printed circuit board 61 beyond the step 110*a,b* to ensure a greater than 1.0 millimeter air gap (considering that the glue 121*a,b* may space the printed circuit board 61 from the steps 110*a,b*).

Surfaces 89*b,d* of middle leg 105 are recessed inwardly from surfaces 91*b,d*, respectively of core 102. Surfaces 89*a–d* of middle leg 105 are also spaced inwardly from the inner edges 90*a–d* of the printed circuit board. The spacing is maintained by contact between the printed circuit board 102 and three surfaces 93*a,b*, 94*a,b* and 95*a,b* of the two outer legs 97*a,b*, respectively. This yields an air gap between the middle leg 105 and the edges 90*a–d* of the printed circuit board 80 and thereby ensures lack of electrical creepage between the middle leg 105 and each of the windings in the printed circuit board. This permits a smaller "dead" area of the printed circuit board, i.e. an area without any windings, near the middle leg because the air gap is an effective way to solve creepage concerns. By way of example, safety specifications may require a 4 millimeter dead area of printed circuit board surface (for 400 volt on the primary winding) between the middle leg 105 and the first, inner conductor, if the middle leg 105 contacts the printed circuit board, but a greater than one millimeter air gap reduces circuit distances to center leg, consequently, conductors can be located closer to the middle leg with the air gap than without the air gap, permitting more or wider conductors to be used. In this example, the middle leg 105 is recessed 1.2 millimeters in from inner edges 90*a–d* of the printed circuit board 61.

The following is an example of other dimensions of core 102:

E'—E' cross-section—0.130"×0.600"
F'—F' cross-section—0.300"×0.600"
G'—G' cross-section—0.270"×0.600"
overall length of core—1.85"
overall width of core—0.600"
length of well—0.660"
length of well minus step—0.600"
width of well at center leg—0.512"
width of well at outer leg—0.600"

Based on the foregoing, transformers according to the present invention have been disclosed. However, numerous modifications and substitutions can be made without deviating from the scope of the present invention. For example, if desired, the rounded corners to the printed circuit board surrounding the middle leg of the core illustrated in FIGS. 5(*a–f*) do not have to be indented into the printed circuit board if the adjacent corners of the middle leg are rounded. Another variation to the means of construction would be to use a pair of "E" core halves rather than the described E.I core combinations. Therefore, the present invention has been disclosed by way of illustration and not limitation, and reference should be made to the following claims to determine the scope of the present invention.

We claim:

1. A transformer comprising:

a core comprising first and second trunk portions substantially parallel with each other and first and second leg portions substantially parallel with each other, said trunk and leg portions being positioned into a substantially rectangular configuration, a third leg portion substantially parallel to said first and second leg portions and interposed midway between said trunk portions, and first and second step portions extending from said first trunk portion adjacent and interior to said first and second leg portions, respectively, and having a shorter height than said first and second leg portions; and a printed circuit board comprising printed primary and secondary windings, said core being mounted to said printed circuit board such that said third leg portion extends through an opening in said printed circuit board and said windings surround said third leg portion inside of said first and second leg portions and said first and second steps abut against one surface of said printed circuit board to offset said printed circuit board from said first trunk portion.

2. A transformer as set forth in claim 1 wherein a cross-sectional area of each of said first and second leg portions is approximately equal to a cross-sectional area of said first trunk portion and the cross-sectional area of said third leg portion is less than twice the cross-sectional area of said first leg portion.

3. A transformer as set forth in claim 1 wherein said third leg portion is narrower than said first and second trunk portions such that opposite surfaces of said third leg portion perpendicular to said first and second leg portions are recessed inwardly from adjacent parallel surfaces of said first and second trunk portions, respectively.

4. A transformer as set forth in claim 1 wherein said opening of said printed circuit board is shaped and positioned to leave air gaps between four surfaces of said third leg portion and adjacent edges of said printed circuit board.

5. A transformer as set forth in claim 1 wherein opposite surfaces of said first and second leg portions are flush with adjacent surfaces of said first and second trunk portions, respectively.

6. A transformer as set forth in claim 1 wherein a cross-sectional area of said first and second leg portions is approximately the same as each other, approximately one half the cross-sectional area of a third leg portion and less than the cross-sectional area of the first trunk portion and less than the cross-sectional area of the second trunk portion.

7. A core as set forth in claim 1 wherein said core is ferrite.

8. A transformer core comprising first and second trunk portions substantially parallel with each other and first and second leg portions substantially parallel with each other, said trunk and leg portions being positioned into a substantially rectangular configuration, a third leg portion substantially parallel to said first and second leg portions and interposed approximately midway between said trunk portions, and first and second step portions extending from said first trunk portion adjacent and interior to said first and second leg portions, respectively, and having a shorter height than said first and second leg portions.

9. A core as set forth in claim 8 wherein opposite surfaces of said first and second leg portions are flush with adjacent surfaces of said first and second trunk portions, respectively.

10. A core as set forth in claim 9 wherein a cross-sectional area of said first and second leg portions is approximately the same as each other, approximately one half the cross-sectional area of the third leg portion and less than the cross-sectional area of the first trunk portion and less than the cross-sectional area of the second trunk portion.

11. A core as set forth in claim 8 wherein said core is ferrite.

12. A core as set forth in claim 8 wherein said first and second trunk portions are not integral with each other.

* * * * *